United States Patent [19]

Hosaka et al.

[11] 4,187,812

[45] Feb. 12, 1980

[54] CLOSED LOOP FUEL CONTROL WITH SAMPLE-HOLD OPERATIVE IN RESPONSE TO SENSED ENGINE OPERATING PARAMETERS

[75] Inventors: Akio Hosaka, Yokohama; Shigeo Aono, Seki, both of Japan

[73] Assignee: Nissan Motor Company, Limited, Yokohama, Japan

[21] Appl. No.: 815,049

[22] Filed: Jul. 12, 1977

[30] Foreign Application Priority Data

Jul. 13, 1976 [JP] Japan ..... 51/82568

[51] Int. Cl.[2] ..... F02M 7/00

[52] U.S. Cl. ..... 123/119 EC; 123/32 EE; 123/32 EH; 123/32 EL

[58] Field of Search ..... 123/119 EC, 32 EA, 32 EE, 123/32 EH, 32 EL; 60/276, 285

[56] References Cited

U.S. PATENT DOCUMENTS

| | | | |
|---|---|---|---|
| 4,046,118 | 9/1977 | Aono | 123/32 EE X |
| 4,075,982 | 2/1978 | Asano | 123/119 EC X |
| 4,111,171 | 9/1978 | Aono et al. | 123/119 EC |

*Primary Examiner*—Tony Argenbright

[57] ABSTRACT

A closed loop fuel control system for an internal combustion engine having in its exhaust system an exhaust composition sensor generating a signal indicative of air-fuel ratio in gases in the exhaust system and an integral controller providing integration on the generated signal for adjusting the ratio of air and fuel supplied to the engine, and a storage device which stores the output from the controller in response to a sensed particular engine operating parameter. The stored signal is later extracted in response to the sensing of the same engine operating parameter to rapidly vary the controller output.

15 Claims, 4 Drawing Figures

CLOSED LOOP FUEL CONTROL WITH SAMPLE-HOLD OPERATIVE IN RESPONSE TO SENSED ENGINE OPERATING PARAMETERS

FIELD OF THE INVENTION

The present invention is concerned with the reduction of undesirable substances in the exhaust gases of internal combustion engine, and specifically it relates to an emission control apparatus by correcting the air-fuel ratio with a feedback control signal derived from an exhaust gas sensor.

BACKGROUND OF THE INVENTION

It is well known that the types and amounts of substances present in engine exhaust is greatly affected by the ratio of air to fuel in the mixture supplied to the engine. Rich mixtures tend to produce high amounts of hydrocarbons and carbon monoxide, whereas lean mixtures tend to produce greater amounts of oxides of nitrogen. It is well known that exhaust gases can be catalytically treated to reduce the amounts of these undesirable components and that the minimization of these undesirable exhaust constituents can be achieved with a single catalytic device provided that the air-fuel mixture supplied to the three-way catalytic converter is maintained within a narrow range at stoichiometry, the so-called "converter window".

It has been suggested that a closed loop fuel control system, in which the air-fuel ratio of the mixture supplied to the engine is controlled by a feedback signal from a zirconia sensor exposed to exhaust gases, can maintain the gases supplied to the catalytic converter within the converter window. However, the design of such a control system must meet a number of requirements. The system must be quick reacting in response to changing engine operating parameters, while at the same time must be stable so that the controlled air fuel mixture spends less time out of the converter window. A number of closed loop fuel control systems have been proposed, but none are completely satisfactory. Most use a zirconia sensor exposed to engine exhaust upstream from the converter and use proportional and integral control in the feedback loop. Such systems do maintain some control over the engine operating point but tend to drift out of the converter window over time as a result of changing engine operating parameters.

SUMMARY OF THE INVENTION

The present invention provides an improved closed loop fuel control system in which a memory device is provided to store control signal indicative of the previous state of a particular engine operating parameter such as acceleration. The stored signal is then used to control air fuel mixture instead of the instantaneous value of the control signal when the engine encounters the next acceleration.

Preferably, the memory device comprises a sample-and-hold circuit which is triggered in response to a detected engine acceleration to store the instantaneous value of, or preferably the mean or average value of, the control signal during the acceleration, until the next acceleration occurs. The advantage is that the control system can respond quickly to acceleration, while the control signal varies gradually at a rate commensurate with the changing engine parameter as the engine enters cruising state so that control is maintained without appreciably drifting out of the converter window during cruise or steady state drive immediately after each acceleration. Since the stored signal is representative of the control value which is most appropriate for the particular engine operation, the stored signal is insensitive to the variations of the engine performance or control system over extended period of time and to car-to-car variations.

The present invention is particularly suitable for integral control, but applicable also to combined integral and proportional control. Further details and advantages of the invention will be apparent from the accompanying drawings and following description of the preferred embodiment.

DESCRIPTION OF THE PREFERRED EMBODIMENTS

Figure 1:
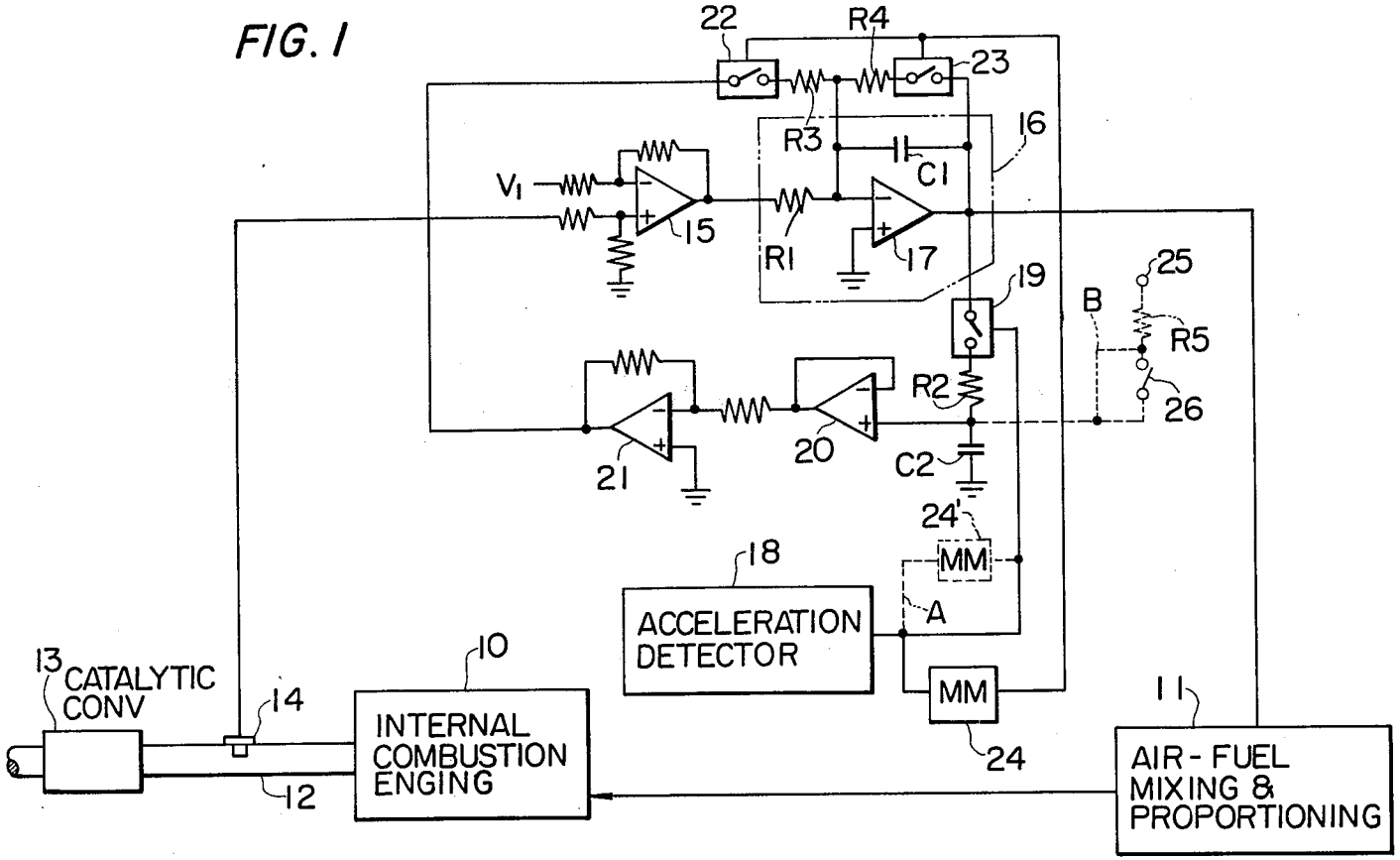
FIG. 1 is a schematic circuit diagram of an embodiment of the invention.

Referring to FIG. 1, an internal combustion engine 10 is supplied with a mixture of air and fuel through appropriate air-fuel mixing and prportioning device 11 such as carburetor, although it could also be fuel injection.

Engine 10 exhausts its spent gases through an exhaust conduit 12 including a catalytic converter 13. Catalytic converter 13 is a device of the type in which exhaust gases flowing therethrough are exposed to a catalytic substance which, given the proper air-fuel ratio in the exhaust gases, will promote simultaneous oxidation of carbon monoxide and hydrocarbons and reduction of oxides of nitrogen. Exhaust conduit 12 is provided with an oxygen sensor 14 upstream from catalytic converter 13. Oxygen sensor 14 is preferably of the zirconia electrolyte type which, when exposed to engine exhaust gases at high temperatures, generate an output voltage which changes appreciably as the air-fuel ratio of the exhaust gases passes through the stoichiometric level. The output voltage of the sensor 14 is a function of air-fuel ratio determined by the air-fuel mixing and proportioning device 11 and exhibits a fairly steep slope as the mixture passes through stoichiometry.

The output from the oxygen sensor 14 is fed into the noninverting input of an operational amplifier 15 which computes the difference between the sensor output and a reference $V_1$, which difference is provided to an integrator 16 comprised by an operational amplifier 17 with its noninverting input connected to ground potential and its inverting input connected to its output by means of an integrating capacitor C1 and to the output of operational amplifier 15 by means of an integrating resistor R1.

The output of the integrator 16 is fed into the air-fuel proportioning device 11 to adjust the air-fuel ratio within the so-called converter window. In accordance with the invention, the output from the integrator 16 is modulated in amplitude in response to the presence of a rich or lean transitory demand condition. Vehicle acceleration is sensed as a rich demand condition by a detector 18 which provides a high voltage level signal to an electronic switch 19 which completes a circuit from the output of integrator 16, resistor R2, capacitor C2 and ground. The detector 18 may be any one of various sensors such as throttle position switch, intake vacuum switch and accelerator pedal switch. The signal from the detector 18 closes the switch 19 and charges the capacitor C2 to the output voltage of the integrator 16 so that the integrator output is sampled during the acceleration period and held until subsequent acceleration. The voltage across capacitor C2 is coupled through a buffer amplifier 20 and through an inverter 21 to an electronic switch 22. The switch 22 is closed in response to an output from a monostable multivibrator 24 to apply the output from the inverter 21 to the inverting input of the integrating amplifier 17 through a resistor R3. Across the capacitor C1 is connected a circuit including a resistor R4 and an electronic switch 23 which is also responsive to the output from the monostable multivibrator 24 to provide a low resistance path in shunt with the capacitor C1. The resistors R3 and R4 have the same resistance value which is much smaller than the integrating resistor R1. The switch 19 may be operated for a desired fixed period by providing a monostable 24' between detector 18 and switch 19 as indicated by broken lines A.

The monostable multivibrator 24 is connected to the output of the acceleration detector 18 to generate a pulse which is present for a short duration from the leading edge of the signal from detector 18.

Figure 2:
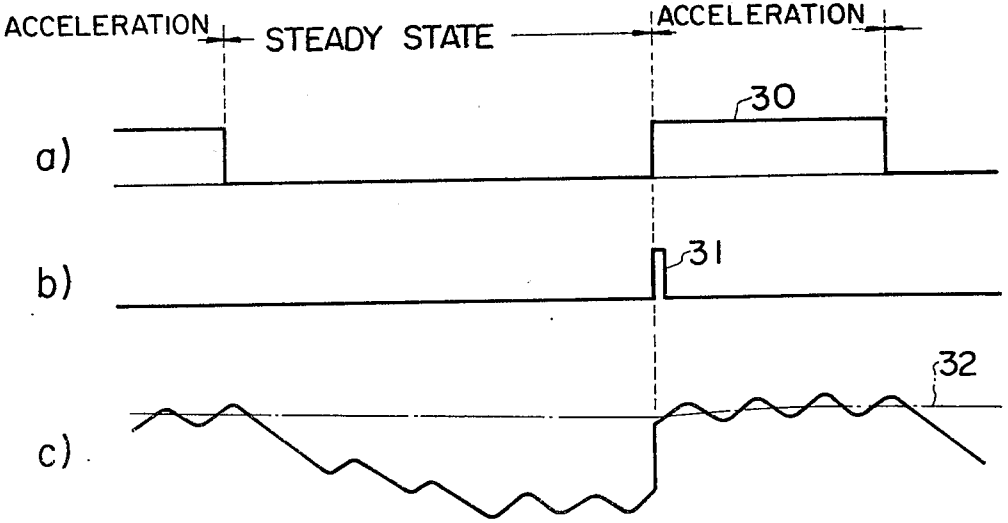
FIG. 2 is a waveform diagram useful for describing the operation of the invention during engine acceleration.

During engine operations other than acceleration, electronic switches 19, 22 and 23 remains open and the integrator 16 provides integration on the signal from the differential amplifier 15 at a ramp rate R1C1. During acceleration a high voltage signal 30 is generated by detector 18 (FIG. 2*a*) and in response to which an output 31 (FIG. 2*b*) is provided from monostable multivibrator 24 to switches 22 and 23 closing their respective paths. At this instant, the voltage stored on capacitor C2 is fed to the inverting input of operational amplifier 17 through resistor R3. Since resistor R4 has much lower resistance value than resistor R1, the output of the integrator 17 instantly takes on a value which is an inverted voltage of the output from the inverter 21. Since the voltage across capacitor C2 at the instant the switches 22, 23 are closed represents the output voltage of the integrator 16 that occurred in the previous acceleration, the output of the integrator now assumed the voltage level of the previous accelerating condition is indicated at 32 in FIG. 2*c*.

The capacitor C2 is recharged by the integrator output during each acceleration period to a renewed value representative of the average or mean value of the integrator output during that period. It is noted from FIG. 2*c* that once the output of integrator 16 jumps to a new value upon the detection of acceleration, the integrating capacitor C1 is charged up to the voltage across C2 and subsequent to the charging of C1 the integrator 16 effects integration on the output from amplifier 15 at the normal ramp rate of R1C1 so that control may oscillate about the acceleration level 32.

Since the action of the circuit R2C2 is to average out the instantaneous values of the integrator output present during acceleration periods, the voltage across capacitor C2 is insensitive to car-to-car variations or aging, and the engine is fed with a mixture of air and fuel in a most appropriate ratio during each acceleration.

Since the capacitor C2 will discharge its stored energy and the voltage to be used for subsequent acceleration will decay over a long period of time, the junction between capacitor C2 and resistor R2 may preferably be connected to a voltage source 25 through a resistor R5 of sufficiently high resistance value and an electronic switch 26 which is arranged to be operated during vehicle start-up periods. With this arrangement, capacitor C2 is charged up to an appropriate voltage level when the interval between successive accelerations is prolonged. Capacitor C2 may be directly connected to resistor R5 by a circuit indicated by broken lines B to be trickle-charged from source 25 if the resistance of R5 is selected at a value much greater than R2.

Figure 3:
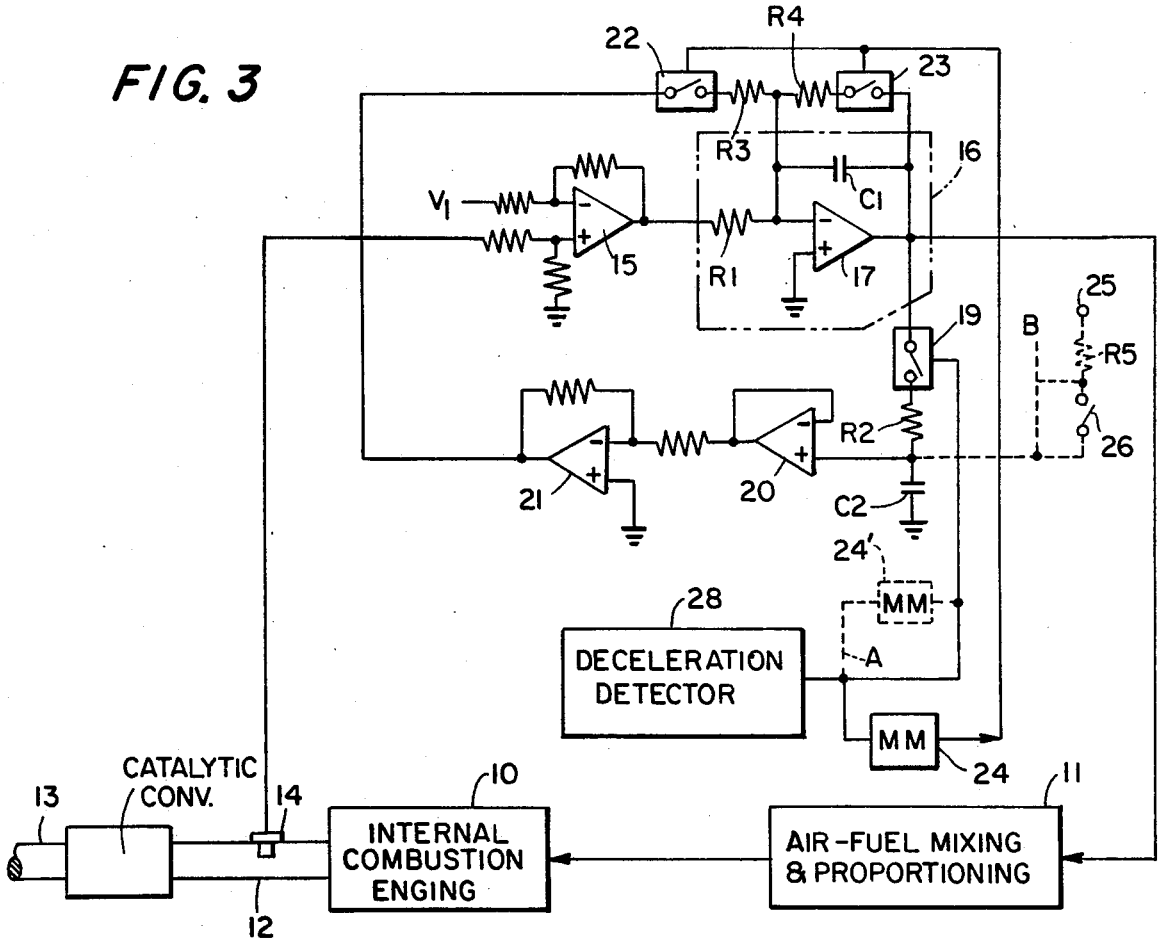
FIG. 3 is another embodiment of the invention in which engine deceleration is detected and FIG. 4 is a waveform diagram useful for describing the operation of the invention during engine deceleration.
Figure 4:
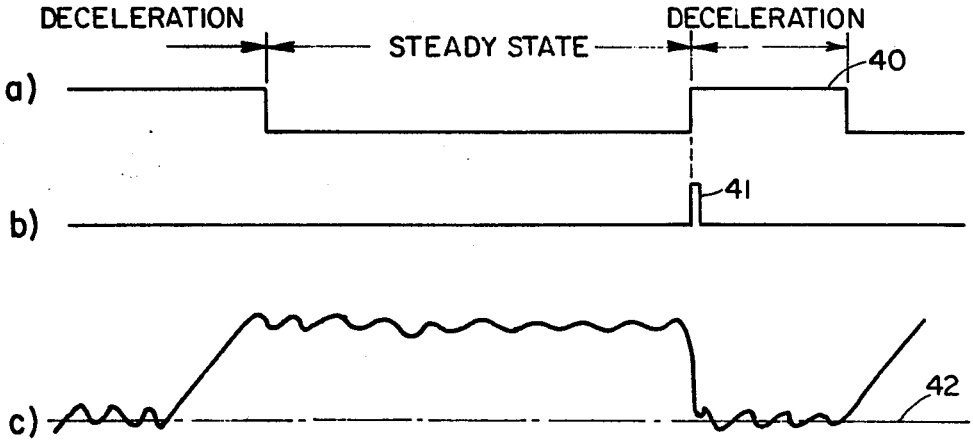

Another embodiment of the invention is shown in FIG. 3 in which a deceleration detector 28 is employed instead of the acceleration detector 18. The monostable 24 is provided with a high voltage input signal 40 (FIG. 4*a*) when the engine is decelerated. The detector 28 may comprise any one of throttle switch, air flow meter and the like. Responsive to the input signal the monostable 24 generates an output pulse 41 (FIG. 4*b*) which is applied to the switches 22 and 23. Since the voltage developed across capacitor C2 at the instant the switches 22 and 23 are closed represents the output voltage of the integrator 16 that occurred in the previous deceleration, the output of the integrator now assumes the voltage level of the previous decelerating condition as indicated at 42 in FIG. 4*c*.

What is claimed is:

1. A closed loop fuel control system for an internal combustion engine including means for supplying air and fuel thereto at a variable ratio and exhaust means, comprising:

means for sensing the concentration of a predetermined constituent of the gases in said exhaust means and sensing the deviation of the air-fuel ratio within said exhaust means from a reference value to provide a correction signal to said air-fuel supplying means;

means for detecting a variation of an operating condition of said engine;

means for sampling said correction signal in response to the detection of said variation of said engine operating condition and storing said sampled signal, said storing means having a characteristic of decreasing the value of the stored signal as a function of time so that said stored signal assumes a value corresponding to an average value of the correction signal generated when said engine operating condition is varied; and means for providing said stored signal to said air-fuel supplying means in response to the detection of a subsequent variation of said engine operating condition.

2. A closed loop fuel control system as claimed in claim 1, wherein said detecting means includes means for detecting a rich mixture transitory demand condition.

3. A system according to claim 1, wherein said detecting means includes means for detecting lean transitory demand conditions.

4. A system as claimed in claim 1, wherein said sampling and storing means comprises a resistor and a capacitor connected in series thereto, and a gate-controlled switching device responsive to said detecting means to connect said capacitor to the output of said correction signal providing means through said resistor, said resistor having such a value of resistance that said capacitor develops a voltage indicative of the average value of said correction signal during the time when said particular operating condition is present.

5. A system as claimed in claim 4, further comprising a voltage source and a second resistor connected between said voltage source and a junction between the first-mentioned resistor and said capacitor, the resistance value of said second resistor being much greater than the resistance value of said first resistor so that said capacitor is trickle charged by the voltage supplied from said voltage source.

6. A system as claimed in claim 4, further comprising a voltage source, a second resistor and a manual switch, said second switch being connected in series between said voltage source and a junction between the first-mentioned resistor and said capacitor to charge the capacitor upon operation of said manual switch.

7. A system as claimed in claim 4, further comprising a monostable multivibrator connected between said engine operating parameter detecting means and the control gate of said gate-controlled switching device.

8. A closed loop fuel control system for an internal combustion engine including means for supplying air and fuel thereto in variable ratio and exhaust means, comprising:

means for sensing the concentration of a predetermined constituent of the gases in said exhaust means and sensing the deviation of the air-fuel ratio within said exhaust means from a reference value;

means for providing an error correction signal for said air fuel supplying means, said correction signal representative of a time integral of the deviation of said air-fuel ratio within said exhaust means;

means for detecting the presence of a particular operating condition of said engine;

means for sampling said error correction signal in response to the detection of said engine operating condition and storing said sampled signal; and means for varying the magnitude of said correction signal so that the same equals to the magnitude of said stored signal upon the detection of said engine operating condition, and wherein said sampling and storing means comprises a resistor and a capacitor connected in series thereto, and a gate-controlled switching device responsive to said detecting means to connect said capacitor to the output of said correction signal providing means through said resistor, said resistor having such a value of resistance that said capacitor develops a voltage indicative of the average value of said correction signal during the time when said particular operating condition is present.

9. A system as claimed in claim 8, wherein said detecting means includes means for detecting rich transitory demand condition.

10. A system as claimed in claim 8, further comprising a voltage source and a second resistor connected between said voltage source and a junction between the first-mentioned resistor and said capacitor, the resistance value of said second resistor being much greater than the resistance value of said first resistor so that said capacitor is trickle charged by the voltage supplied from said voltage source.

11. A system as claimed in claim 8, further comprising a voltage source, a second resistor and a manual switch, said second switch being connected in series between said voltage source and a junction between the first-mentioned resistor and said capacitor to charge the capacitor upon operation of said manual switch.

12. A system as claimed in claim 8, further comprising a monostable multivibrator connected between said engine operating parameter detecting means and the control gate of said gate-controlled switching device..

13. A system as claimed in claim 8, wherein said detecting means includes means for detecting lean transitory demand condition.

14. A closed loop fuel control system for an internal combustion engine including means for supplying air and fuel thereto in variable ratio and exhaust means, comprising:

means for sensing the concentration of a predetermined constituent of the gases in said exhaust means and sensing the deviation of the air-fuel ratio within said exhaust means from a reference value;

means for providing an error correction signal for said air fuel supplying means, said correction signal representative of a time integral of the deviation of said air-fuel ratio within said exhaust means;

means for detecting the presence of a particular operating condition of said engine;

means for sampling said error correction signal in response to the detection of said engine operating condition and storing said sampled signal; and means for varying the magnitude of said correction signal so that the same equals to the magnitude of said stored signal upon the detection of said engine operating condition, and wherein said error correction signal providing means comprises an operational amplifier with a first input responsive to said deviation of air-fuel ratio through a first integating resistor and a second input connected to a reference potential, an integrating capacitor connected between said first input and an output of said operational amplifier, and wherein said input varying means comprises a second resistor and a second gate-controlled switching device responsive to the detection of said operating condition of the engine to apply said stored correction signal through said second resistor to said first input of said operational amplifier, and a third resistor and a third gate-controlled switching device responsive to the detection of said operating condition of the engine to connect said third resistor in parallel with said integrating capacitor said second resistor having a smaller value of resistance than said first resistor so that said integrating capacitor is instantly charged up to a level substantially equal to said stored correction signal.

15. A system as claimed in claim 14, further comprising a monostable multivibrator connected between said engine operating parameter detecting means and the control gate of said second and third gate-controlled switching devices.

* * * * *